US006551410B2

(12) United States Patent
Crevasse et al.

(10) Patent No.: US 6,551,410 B2
(45) Date of Patent: Apr. 22, 2003

(54) METHOD OF CLEANING A SEMICONDUCTOR WAFER WITH A CLEANING BRUSH ASSEMBLY HAVING A CONTRACTIBLE AND EXPANDABLE ARBOR

(75) Inventors: Annette M. Crevasse, Apopka, FL (US); William G. Easter, Orlando, FL (US); John A. Maze, Clermont, FL (US); Frank Miceli, Orlando, FL (US)

(73) Assignee: Agere Systems Inc., Allentown, PA (US)

( * ) Notice: Subject to any disclaimer, the term of this patent is extended or adjusted under 35 U.S.C. 154(b) by 109 days.

(21) Appl. No.: 09/737,717

(22) Filed: Dec. 15, 2000

(65) Prior Publication Data

US 2002/0074016 A1 Jun. 20, 2002

(51) Int. Cl.[7] ..... A46B 17/02; B08B 1/00

(52) U.S. Cl. ..... 134/6; 134/32; 15/77; 15/88.2; 15/179; 15/180; 15/230; 15/230.18

(58) Field of Search ..... 134/2, 6, 32; 15/77, 15/179, 180, 230, 230.18, 102, 88.3

(56) References Cited

U.S. PATENT DOCUMENTS 5,647,083 A * 7/1997 Sugimoto et al. ..... 15/77
5,829,087 A * 11/1998 Nishimura et al. ..... 15/88.2

* cited by examiner

*Primary Examiner*—Zeinab El-Arini

(57) ABSTRACT

A method of cleaning a semiconductor wafer using a cleaning brush assembly having an arbor with: (1) an expandable member configured to have a non-expanded position and an expanded position, and (2) a cleaning brush, located about the expandable member, having an inner diameter greater than an outer diameter of the expandable member in the non-expanded position and less than an outer diameter of the expandable member in the expanded position.

12 Claims, 8 Drawing Sheets

METHOD OF CLEANING A SEMICONDUCTOR WAFER WITH A CLEANING BRUSH ASSEMBLY HAVING A CONTRACTIBLE AND EXPANDABLE ARBOR

TECHNICAL FIELD OF THE INVENTION

The present invention is directed, in general, to semiconductor wafer cleaning brushes and, more specifically, to a semiconductor wafer cleaning brush assembly having a contractible and expandable arbor.

BACKGROUND OF THE INVENTION

During semiconductor manufacturing, several processes create debris that must be removed from the semiconductor wafers to prevent any contamination of the integrated circuits (ICs) derived from the wafers. Some of the processes well known for depositing contaminating particles on the surface of semiconductor wafers are silicon polishing, laser scribing and chemical/mechanical polishing.

Silicon polishing is performed after a silicon ingot is cut into wafers to prepare the wafers for further precessing. Laser scribing is the process by which identifying numbers are scribed into the wafer, and chemical/mechanical polishing uses an abrasive slurry to planarize the wafer surface. Each of these processes creates debris or chemical residue that may adhere to the wafer surface and present a potential contamination hazard. However, the most common particles left on the wafer are metals from a metal CMP process and dielectric oxide materials from a dielectric CMP process. Among these particles are tungsten, titanium, titanium nitride, aluminum, tantalum, copper, polishing pad particles and slurry particles. With the high cost of semiconductor manufacturing and intense competition among manufacturers, every effort must be made to minimize the contamination hazard presented by one of more of these particles. Additionally, even fewer defects per area of semiconductor material are required for smaller geometries for the devices to be considered functional.

Thus, for reasons of both thoroughness and efficiency, these contaminants are perhaps best removed from the wafer surface by a combination of chemical and mechanical means. In a typical wafer cleaning apparatus, the surfaces of the semiconductor wafer are best cleaned of any residual debris by passing the wafer between two rollers equipped with cleaning brushes usually constructed of polyvinyl alcohol (PVA). Ammonium hydroxide or dilute hydrofluoric acid is also commonly used as a component of the cleaning solutions used for semiconductor wafer cleaning. In addition, the PVA cleaning brushes may also be kept wetted with de-ionized water to provide the high quality surface necessary for removing debris. While in use, the combination of brush rotation and pressure applied to the semiconductor wafer through the brushes provides for the proper cleaning of the semiconductor wafer surfaces.

Once a cleaning brush has exceeded its useful life and can no longer adequately clean the wafer surface, the brush must be replaced. In spite of the advances achieved in successfully removing the contaminants from wafer surfaces, replacement of such cleaning brushes still presents a problem. The brushes must be held snugly by the roller on which they are mounted to prevent bunching-up of the brush surface during the cleaning process. If any portion of the brush surface is permitted to bunch-up or wrinkle during cleaning, an uneven brush surface is created and the irregular raised portions of the brush may inadvertently scratch or other wise damage the wafer. In addition, the portions of the brush surface that remain wrinkle-free may now be unable to contact the wafer surface to effectively clean the wafer surface.

To prevent the cleaning brushes from developing any wrinkles or otherwise bunching-up during the cleaning process, the brushes must be held very securely by their respective rollers, and thus have been forcibly stretched and pulled around the roller. Although the material of the cleaning brush is often somewhat pliable, those skilled in the art still find the task of removing and replacing a cleaning roller in such a manner a tedious and labor-intensive affair. Additionally, these difficulties may even increase depending on the person attempting to replace the cleaning brush.

Numerous problems abound when a cleaning brush is forcibly stretched around a mounting roller. Perhaps most notably, by forcing a cleaning brush onto a larger roller, the brush material may tear or become otherwise damaged. Understandably, when the brush is so damaged it may no longer retain its original strength and prematurely wear during the cleaning process. Due to the expense of replacing wafer cleaning brushes, it is desirable to extend the life of the cleaning brushes as long as possible. Moreover, should the brush material completely fail during the cleaning process, the exposed roller surface may severely damage the wafer being cleaned, an expensive gamble in today's competitive semiconductor market.

In addition to the risk of damaging the brush itself, forcibly applying a brush to a roller is a time-consuming task. Beyond the frustration that can develop when a technician is required to forcibly stretch a cleaning brush over a roller, the time necessary to successfully change the brush results in lost down-time for the cleaning apparatus. While the technician struggles with removing and replacing the brush, the cleaning apparatus is unable to clean incoming semiconductor wafers. Thus, the manufacturer incurs revenue loss due to the excess time the cleaning apparatus is out of commission. Moreover, even though great care may be taken while stretching the brush over the roller, forcibly stretching material in such a manner may still result in wrinkles on the brush surface.

Prior art efforts to minimize the damage likely caused by forcibly stretching the brushes onto their rollers are scarce at best. One such effort involves a device coated with a low friction material, such as Teflon®, to assist in sliding the brush onto the roller. The low friction material creates a smoother interface between the inside of the brush and the outside of the roller while the brush is being mounted on the roller. Unfortunately, even this effort to "shoe-horn" the brush onto the roller results in little relief from the problems discussed above. Whether a smoother interface is created, this prior art device still involves forcibly stretching the brush onto the roller, and as such, may still result in wrinkling, tearing or over-stretching the brush material. Over time, this device is repeatedly scraped and scratched during the mounting process, which may result in scraped particles removed from the device being deposited on the wafer surface. Since the cleaning process is designed to rid wafers of contaminating particles, a device that inadvertently deposits contaminants on the wafer surface may be more detrimental to the cleaning process than helpful.

Accordingly, what is needed in the art is a way of mounting a cleaning brush to the roller of a cleaning apparatus that does not suffer from the deficiencies found in the prior art.

SUMMARY OF THE INVENTION

To address the above-discussed deficiencies of the prior art, the present invention provides a semiconductor wafer cleaning brush assembly having an arbor with an expandable member configured to have a non-expanded position and an expanded position, and a cleaning brush, loadable about the expandable member, having an inner diameter greater than an outer diameter of the expandable member in the non-expanded position and less than an outer diameter of the expandable member in the expanded position. One or more such brush assemblies may be placed within a cleaning apparatus for cleaning the surfaces of a semiconductor wafer.

BRIEF DESCRIPTION OF THE DRAWINGS

For a more complete understanding of the present invention, reference is now made to the following descriptions taken in conjunction with the accompanying drawings, in which.

DETAILED DESCRIPTION

Figure 1:
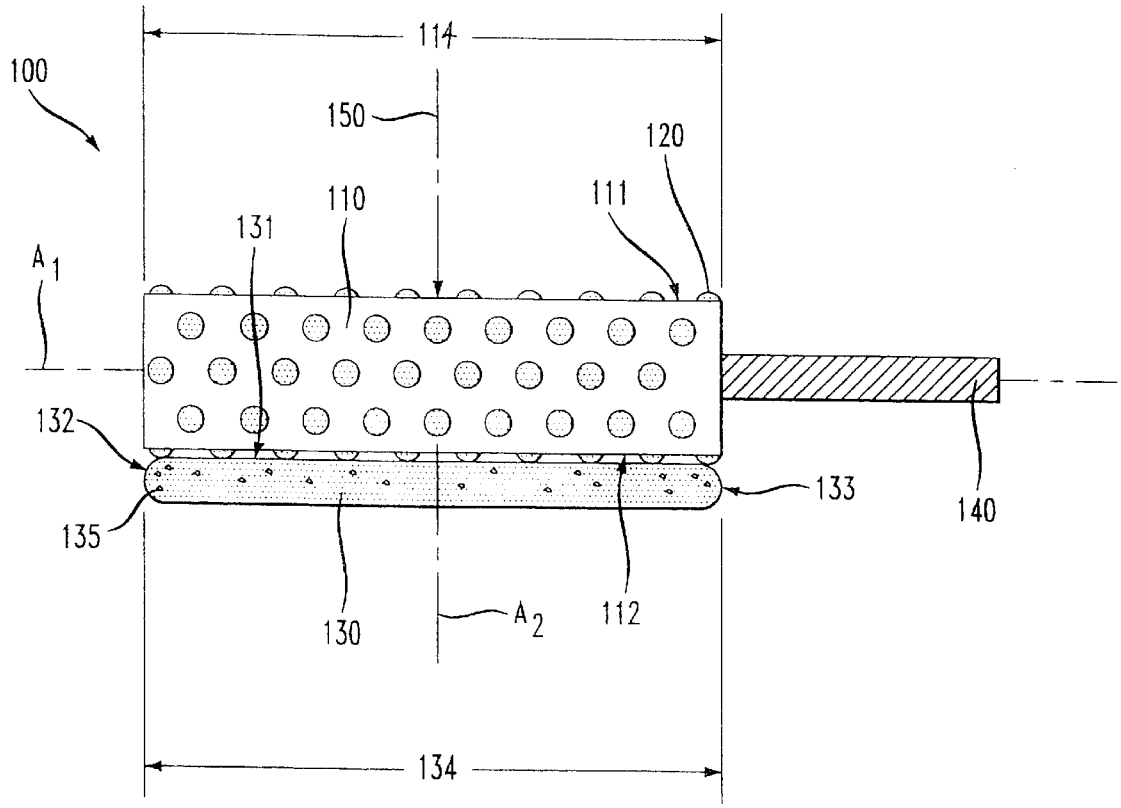
FIG. 1 PRIOR ART
FIG. 1 illustrates a side view of a conventional semiconductor wafer cleaning brush assembly.

Referring initially to FIG. 1, illustrated is a side view of a conventional semiconductor wafer cleaning brush assembly 100. The conventional brush assembly 100 includes a cylindrical, spongy cleaning brush 110 made of microporous polyvinyl alcohol (PVA). Although cleaning brushes made of other materials can be found in the prior art, the most common material is PVA. The brush 110 includes cleaning nubs 120 distributed about the surface of the brush 110. The brush assembly 100 further includes an arbor 140 or core onto which the brush 110 is mounted. The arbor 140 and brush 110 are then rotated about a longitudinal axis $A_1$ during the cleaning process for a semiconductor wafer 130. Additionally, the wafer 130 may be configured to rotate about a second axis $A_2$ as it passes under the brush assembly 100. Alternatively, the brush assembly 100 may be nutated slightly across the wafer 130.

For efficient cleaning, the length 114 of the brush 110 is sized reasonably close to the wafer diameter 134. As can be seen from the side view of the wafer 130, the brush 110 has reasonably straight sides 111, 112. These straight sides 111, 112 conform reasonably well to a flat surface 131 of the wafer 130. The microporous PVA is reasonably compliant so that a small downward force 150 may be applied to the wafer surface 131 as the brush assembly 100 is rotated about the first axis $A_1$ in an effort to remove contaminating particles 135 from the surface 131 of the wafer 130.

Once the brush 110 portion of the brush assembly 100 has worn beyond its ability to reasonably clean the wafer 130, it must be replaced. If the brush 110 is not replaced, contaminating particles 135 left on the wafer 130 during CMP or other processes may survive the cleaning process and continue to contaminate the integrated circuits (Ics), which are located on the wafer 130. As discussed above, removing the worn brush 110 and replacing it with a new one is a daunting and tedious task. Although there may exist devices or methods in the prior art to assist in the replacement, those devices and methods continue to suffer from similar deficiencies. These not only include wrinkles developing on the brush 110 surface from forcibly stretching the brush 110 material onto the arbor 140, but may also include foreign particles being deposited in the wafer surface 131. However, as discussed below these deficiencies may now be overcome by the present invention.

Figure 2:
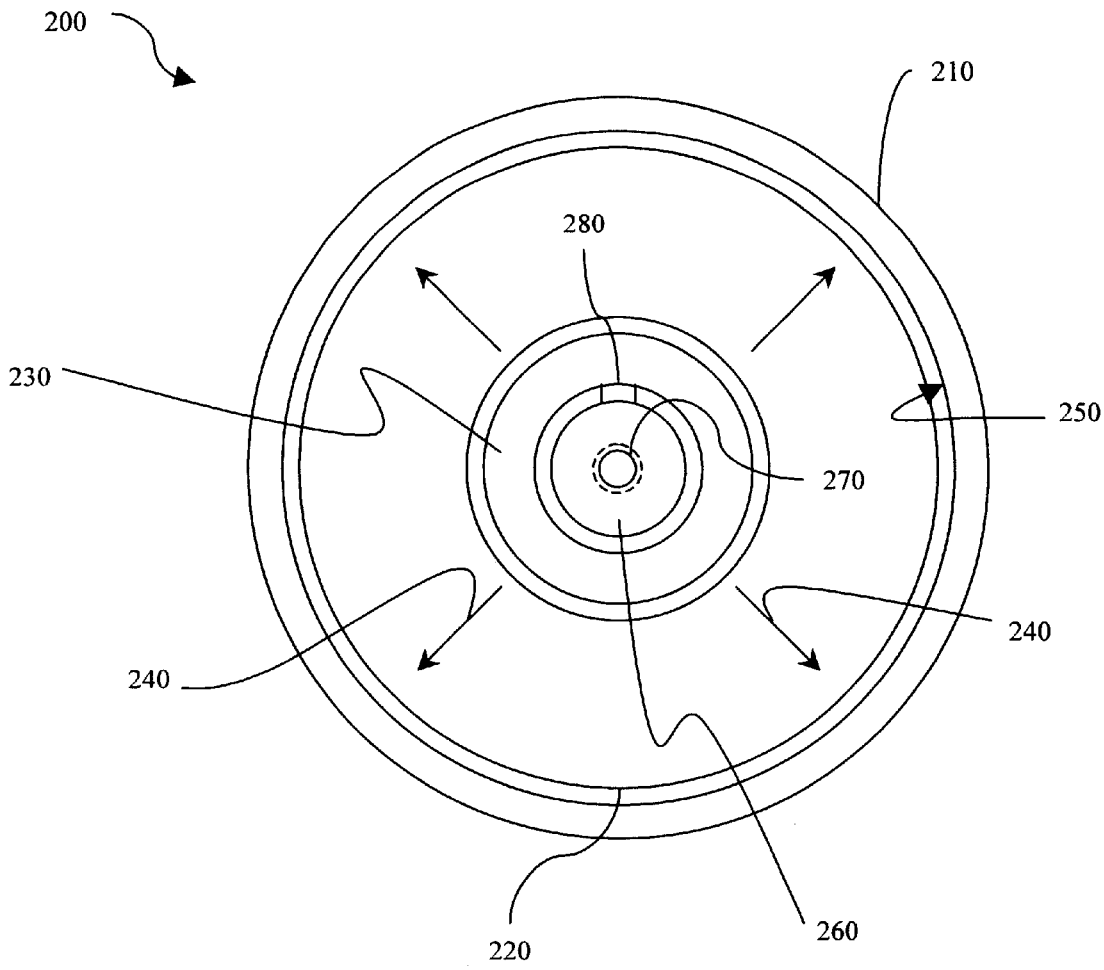
FIG. 2 illustrates one embodiment of a wafer cleaning brush assembly constructed according to the principles of the present invention.

Turning now to FIG. 2, illustrated is one embodiment of a wafer cleaning brush assembly 200 constructed according to the principles of the present invention. The brush assembly 200 includes a cylindrical cleaning brush 210 for directly contacting and cleaning the surface of a semiconductor wafer (not illustrated). Although the brush 210 may have cleaning nubs or grooves to increase cleaning efficiency, for ease of illustration no such additions have been illustrated herein. Additionally, although only one brush assembly 200 is illustrated, the present invention is sufficiently broad to encompass a cleaning apparatus having multiple opposing brush assemblies 200 located therein.

The brush assembly 200 further includes an arbor (220, 230, 260) on which the brush 210 is mounted. The arbor is comprised of a mounting shaft 260, an annular bladder 230 located about the shaft 260 and an expandable member 220. In the illustrated embodiment, the shaft 260 includes a fluid passage 270, and a fluid valve 280 coupled to and in fluid communication with the fluid passage 270 and to an interior of the annular bladder 230. In the illustrated embodiment, the fluid valve 280 is a pneumatic valve 280 coupled to and in fluid communication with a pneumatic passage 270 and to the interior of an annular air bladder 230. Of course, the present invention is not so limited and may even encompass a hydraulic valve 280 coupled to and in fluid communication with a hydraulic passage 270 and the interior of annular hydraulic bladder 230.

Placing the brush 210 onto the arbor according to the present invention requires far less effort than required in the prior art. Specifically, a technician simply positions the brush 210 about the arbor of the brush assembly 200. Once the brush 210 is properly positioned about the arbor, the annular bladder 230 is inflated to a predetermined pressure by attaching a pressure source to the fluid passage 270 and causing fluid to flow through the fluid valve 280 and into the interior of the annular bladder 230. As the pressure is increased in the annular bladder 230, it expands in size. While expanding, the annular bladder 230 contacts the inner wall of the expandable member 220, causing the expandable member 220 to expand in the outward direction 240. When the expandable member 220 reaches its expanded position, the outer wall of the expandable member 220 resiliently bears against an inner diameter 250 of the brush 210. By securely bearing against the inner diameter 250 of the brush 210, the brush 210 is held firmly in place so as to properly clean one or more semiconductor wafers (not illustrated).

In a particularly advantageous embodiment of the present invention, the expandable member 220 is comprised of a semi-rigid material, perhaps polyurethane. In such an embodiment, the expandable member 220, being only semi-rigid in composition, easily moves to an expanded position when forced by the annular bladder 230.

During the cleaning process, the brush 210 may eventually become overly worn and require replacement. In accordance with the present invention, replacement of the brush 210 is an equally simple task. The technician first deflates the arbor to a non-expanded position by causing fluid to drain from the annular bladder 230, lowering the pressure therein. As the annular bladder 230 loses pressure it contracts in size. The expandable member 220, comprised of a semi-rigid material with sufficient elasticity to return to its original size, is then allowed to contract and reach its non-expanded position. Since the inner diameter 250 of the brush 210 is greater than the outer diameter of the expandable member 220 in its non-expanded position, the brush 210 is easily passed over the arbor and removed from the assembly 200. With the present invention, a technician is thus able to remove and replace a cleaning brush in far less time with far less effort, and with little or no damage to the brush 210 itself, than using the devices and methods found in the prior art.

With an arbor having expanded and non-expanded positions, the present invention provides a number of advantages over the devices and methods of the prior art. As discussed above, the placement of a cleaning brush onto an arbor in the prior art usually requires the technician to forcibly pull the brush onto the arbor. Such forcing, in turn, often results in the over-stretching or tearing of the brush. A brush permitted to operate in this condition more often than not has a lesser useful life than a brush not placed under such strain during mounting. Moreover, even if the brush survives without tearing, wrinkles may still develop in those parts of the brush over-stretched during placement on the arbor. Such wrinkles, in turn, can cause significant damage to the surface of a wafer. Having an arbor configured to expand and contract according to the present invention provides a quick and easy means to replace a cleaning brush without the risks associated with the prior art.

Figure 3:
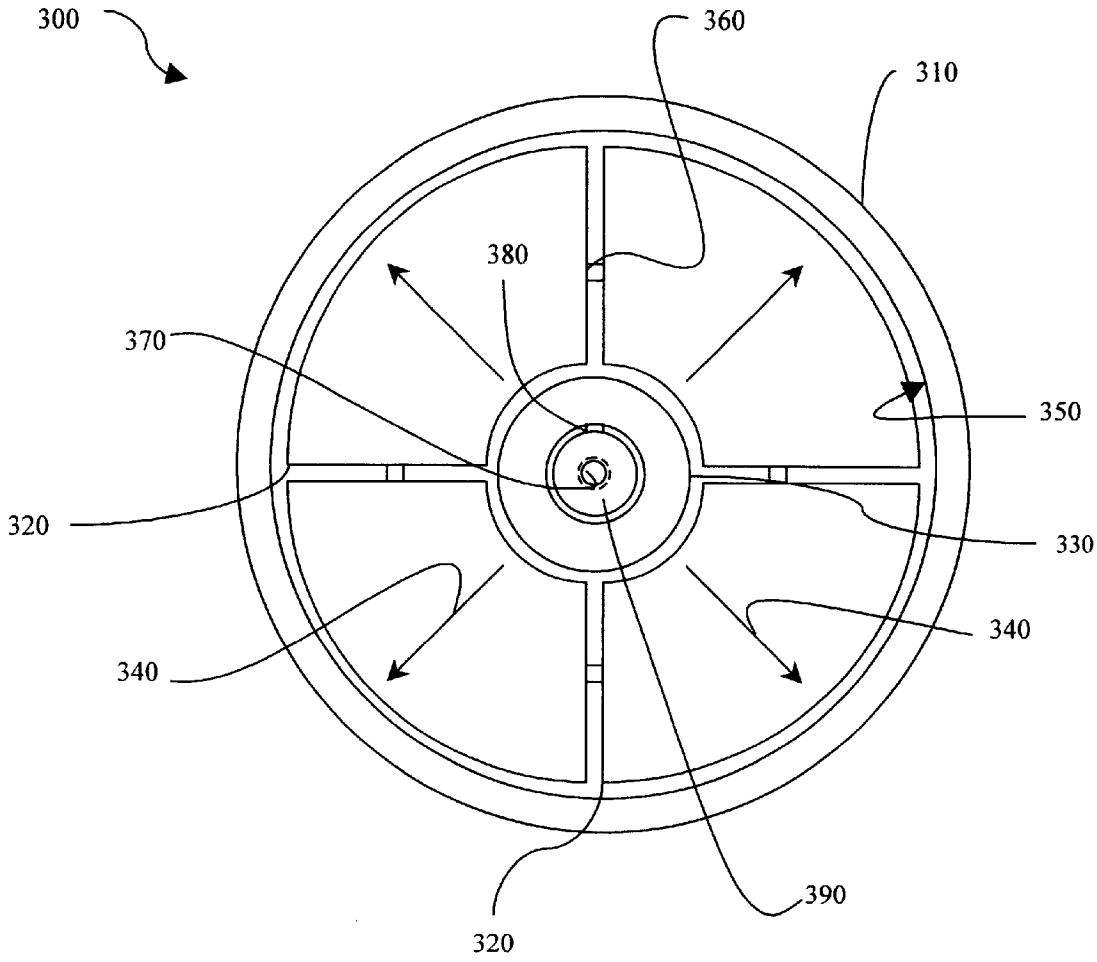
FIG. 3 illustrates another embodiment of a cleaning brush assembly of the present invention.

Turning now to FIG. 3, illustrated is another embodiment of a cleaning brush assembly 300 of the present invention. The brush assembly 300 again includes a cylindrical cleaning brush 310 for use in cleaning the surface of a wafer (not illustrated) after the CMP or other process where contaminants may be introduced to the wafer surface.

The brush assembly 300 also includes an arbor (320, 330, 390) on which the brush 310 is mounted. The arbor in FIG. 3 is comprised of a mounting shaft 390, an annular bladder 330 located about the shaft 390 and an expandable member 320. In this embodiment of the present invention, the shaft 390 still includes a fluid passage 370, and a fluid valve 380 coupled to and in fluid communication with both the fluid passage 370 and an interior of the annular bladder 330. However, as illustrated, the expandable member 320 is now composed of a rigid material and includes multiple radially-moveable segments. In addition, the moveable segments of the expandable member 320 are held together with expandable support members 360.

The support members 360 are composed of a material having a predetermined elasticity sufficient to pull the segments together when there is no force present to drive them apart. As a result, when the segments are kept in contact with one another by the support members 360, the expandable member 320 has an outer diameter less than an inner diameter 350 of the brush 310. Conversely, when the segments are forced apart from each other, the outer diameter of the expandable member 320 increases, eventually slightly exceeding the size of the inner diameter 350.

To place the brush 310 onto the arbor in this exemplary embodiment, with the expandable member 320 in the non-expanded position the brush 310 is again simply passed about the expandable member 320 until it is in the proper position. Once there, the technician causes fluid to enter and pressurize the annular bladder 330 through the fluid passage 370 and the fluid valve 380. As the pressure increases, the annular bladder 330 expands and causes the moveable segments of the expandable member 320 to expand in an outward direction 340. When the expandable member 320 reaches its expanded position, the segments contact the inner diameter 350 of the brush 310, which is less than the outer diameter of the expandable member 320 in its expanded position, securely holding the brush 310 in the proper cleaning position. As with the brush assembly 200 illustrated in FIG. 2, the arbor of the brush assembly 300 of FIG. 3 securely holds the brush 310 in position without risk of tearing or wrinkling from forcibly stretching and pulling the brush 310 over the arbor.

Similarly, removing the brush 310 is an equally simple task. When the brush 310 requires replacement, the technician depressurizes the annular bladder 330 causing it to contract in size. The elasticity of the support members 360 of the expandable member 320 causes the segments of the expandable member 320 to move closer together, decreasing the outer diameter of the arbor holding the brush 310. Once this outer diameter is less than the inner diameter 350 of the brush 310, the brush 310 may be easily removed from the arbor with little or no effort. Then, placing a replacement brush on the arbor follows the process described above. With the expandable member 320 having an expanded and non-expanded position, the brush assembly 300 of FIG. 3 provides the same advantages over the prior art discussed with respect to the embodiment illustrated in FIG. 2. Also like the assembly 200 of FIG. 2, the brush assembly 300 is broad enough to encompass a pneumatic or hydraulic annular bladder 330, fluid valve 380 and fluid passage 370.

Figure 4A:
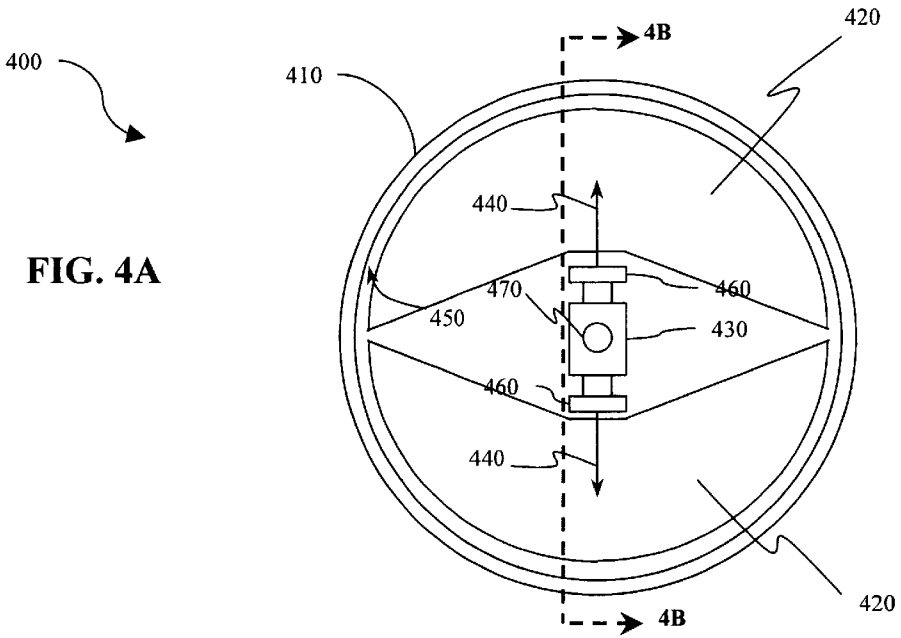
FIG. 4A illustrates an end, sectioned view of another advantageous embodiment of a cleaning brush assembly.
Figure 4B:
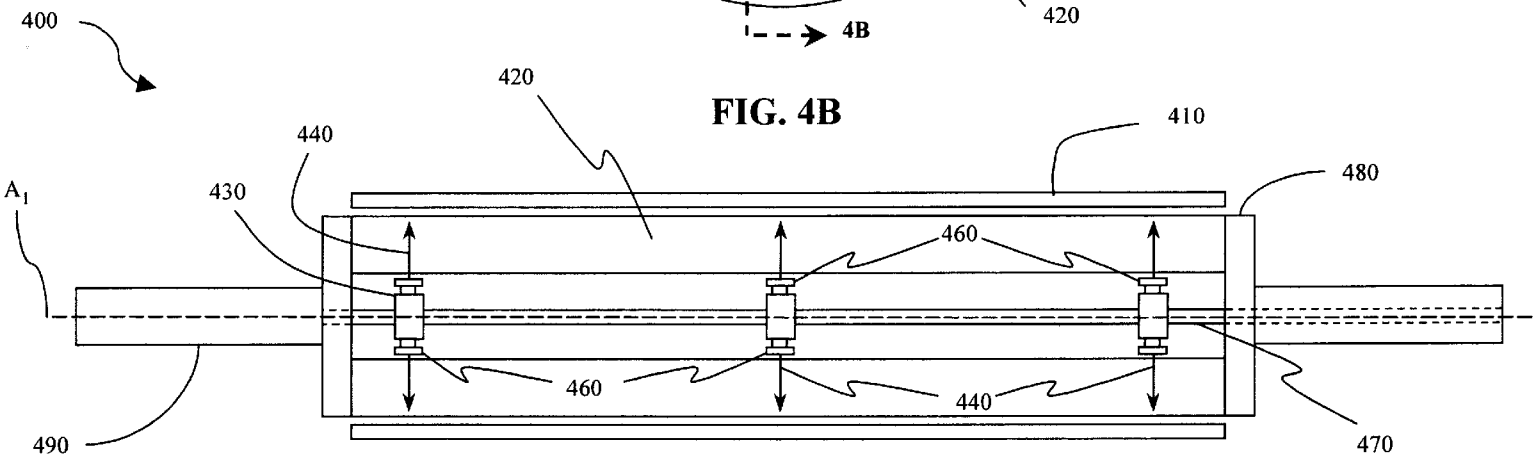
FIG. 4B illustrates a side, sectioned view of the assembly of FIG. 4A.

Viewing FIGS. 4A and 4B concurrently, another advantageous embodiment of a cleaning brush assembly 400 is illustrated. Specifically, FIG. 4A illustrates an end, sectioned view of the brush assembly 400, while FIG. 4B illustrates a side, sectioned view of the brush assembly 400. The brush assembly 400 includes a cleaning brush 410 and an arbor (420, 430, 460, 470, 480, 490) on which the brush 410 is mounted.

In this embodiment, the arbor is comprised of an expandable member 420 having opposing essentially semi-circular elements extending the length of the brush 410. The ends of the elements are moveably secured along the periphery of a stabilizing hub 480 at each end of the arbor. The stabilizing hubs 480 are coupled to handles 490 at each end of the brush assembly 400 used to hold the brush assembly 400 in the proper cleaning position. An axle 470 extends the length of the arbor along a longitudinal axis $A_1$, and is secured by, but permitted to rotate within, the center of each stabilizing hub 480. The elements of the expandable member 420 are located about the axle 470 and present an outer diameter of the expandable member 420 less than an inner diameter 450 of the brush 410 when in the non-expanded position.

The arbor further includes hydraulic expanders 430 fluidly and mechanically coupled to the axle 470. The expanders 430 are configured to exert a force in the outward direction 440 through pistons 460 coupled to opposing ends of the expanders 430. The pistons 460, in turn, an expanding force in the outward direction 440 to the interior faces of the elements. In the illustrated embodiment, the axle 470 is a hydraulic tube and provides both structural support for the expanders 430, as well as a passage for the hydraulic fluid used to pressurize the pistons 460. Although three expanders 430 are illustrated in the brush assembly 400, the present invention is not limited to any particular number of expanders 430.

When the expanders 430 are pressurized and the pistons 460 are moved in opposing outward directions 440, the elements of the expandable member 420 are also moved in the outward direction 440.

This causes the expandable member 420 to be moved to its expanded position and press against the inner diameter 450 of the brush 410 positioned around the arbor. Once the expandable member 420 presses firmly against the inner diameter 450, the brush 410 is securely held in place.

Figure 5A:
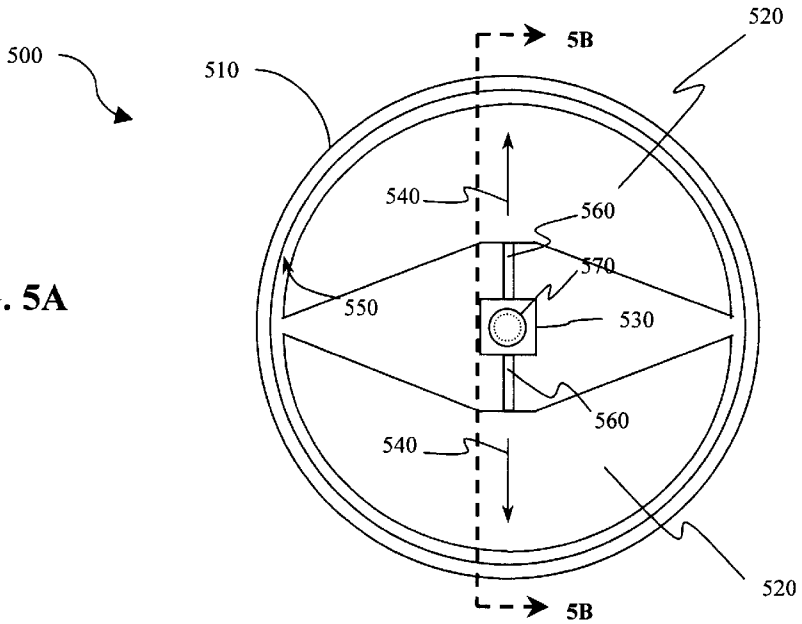
FIG. 5A illustrates an end, sectioned view of an alternative embodiment of the brush assembly of FIGS. 4A and 4B.
Figure 5B:
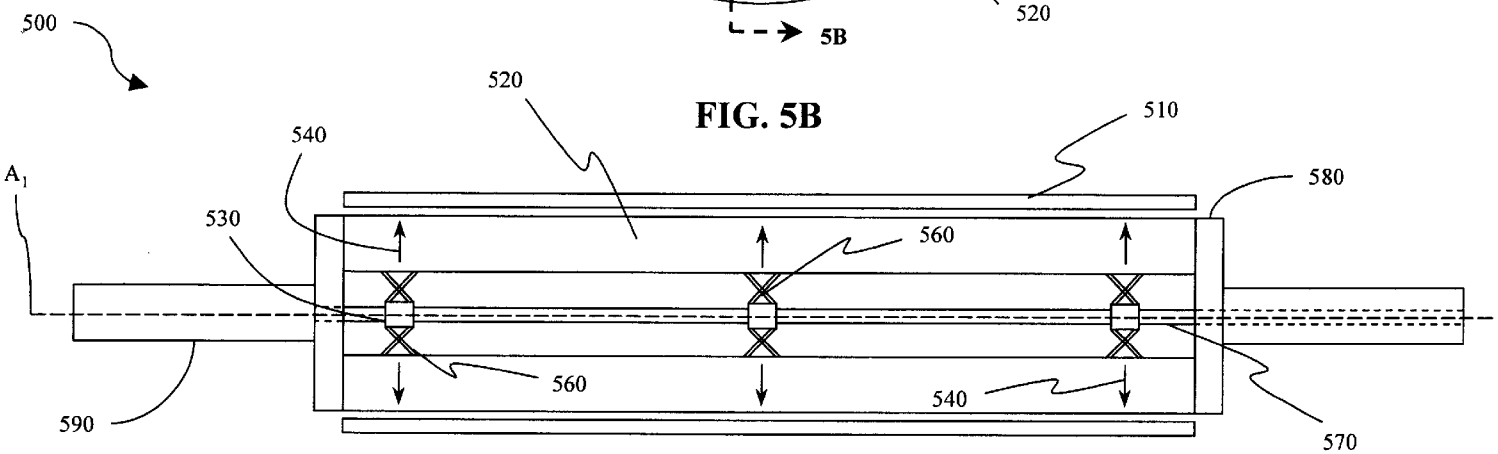
FIG. 5B illustrates a side, sectioned view of the assembly of FIG. 5A.

Referring now to FIGS. 5A and 5B concurrently, illustrated is an alternative embodiment of the brush assembly 400 of FIGS. 4A and 4B. FIG. 5A illustrates an end, sectioned view of the brush assembly 500. FIG. 5B illustrates a side, sectioned view of the brush assembly 500.

The brush assembly 500 again includes a cleaning brush 510 and an arbor (520, 530, 560, 570, 580, 590) on which the brush 510 is to be mounted. In this embodiment the arbor is still comprised of an expandable member 520 having opposing essentially semi-circular elements extending the length of the brush 510. The ends of the elements are moveably secured along the periphery of stabilizing hubs 580 at the ends of the arbor, which in turn are coupled to handles 590 used to hold the brush assembly 500 in the proper cleaning position.

An axle 570 in this brush assembly 500 still extends the length of the arbor along its longitudinal axis $A_1$ and is secured by, and permitted to rotate within, the center of each stabilizing hub 580. In addition, the elements of the expandable member 520 are located about the axle 570 and present an outer diameter of the expandable member 520 less than an inner diameter 550 of the brush 510 when in the non-expanded position. However, in this embodiment of the present invention the axle 570 is a threaded rod providing structural support for multiple expanders 530. As before, although three expanders 530 are illustrated in the brush assembly 500, the present invention is not limited to any particular number of expanders 530.

The expanders 530 now include scissor jacks 560 or similar mechanical devices on opposing ends of each expander 530, and are threadedly coupled to the axle 570. As the axle 570 is rotated, the expanders 530 are configured to exert a force in the outward direction 540 through the opposing scissor jacks 560 coupled to ends of the expanders 530. The scissor jacks 560, in turn, transmit these opposing forces in the outward direction 540 to the interior faces of the elements of the expandable member 520. As this action causes the expandable member 520 to be moved to its expanded position, the elements press firmly against the inner diameter 550 of the brush 510, securely holding the brush 510 in place for the cleaning process.

Figure 6:
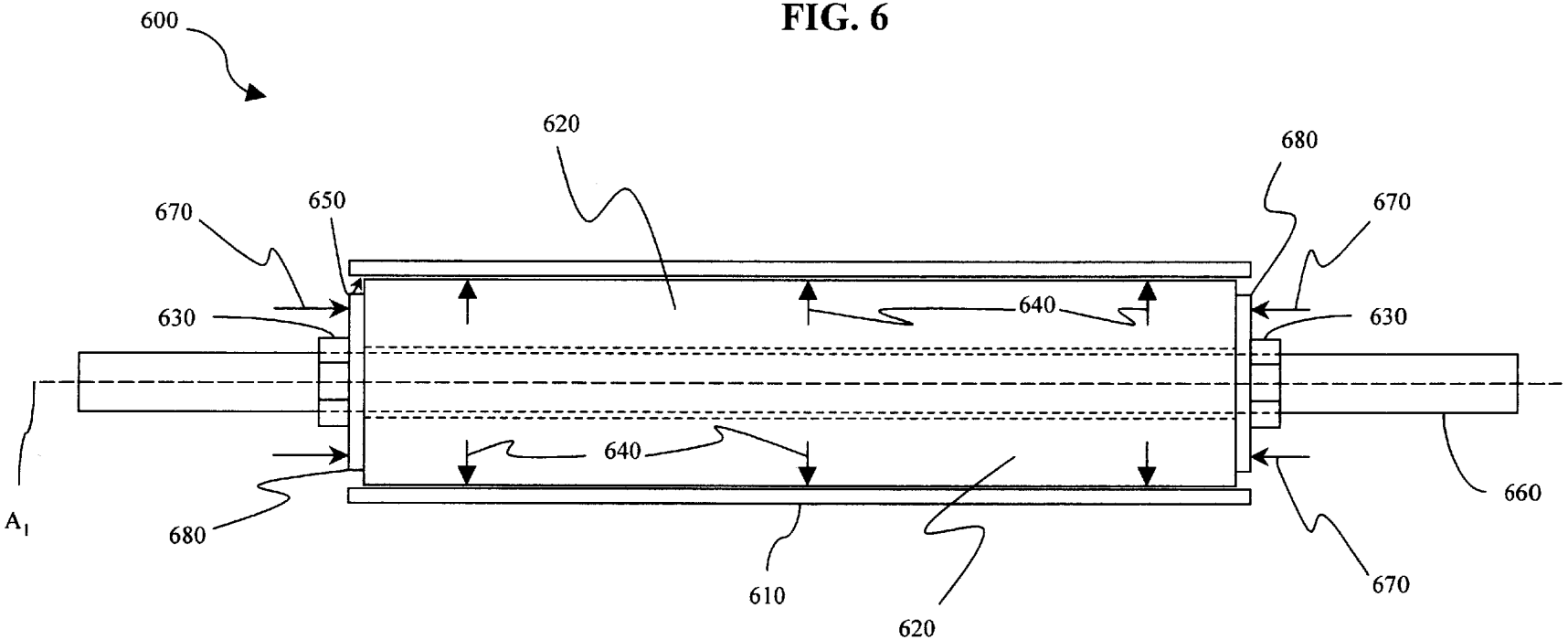
FIG. 6 illustrates a side, sectioned view of another cleaning brush assembly following the principles of the present invention.

Turning now to FIG. 6, illustrated is a fifth embodiment of the present invention. Specifically, FIG. 6 illustrates a side, sectioned view of another cleaning brush assembly 600 following the principles of the present invention.

The brush assembly 600 includes a cleaning brush 610 and an arbor (620, 630, 660, 680) having an expandable member 620. In the illustrated embodiment, the expandable member 620 is composed of a semi-rigid material having an elasticity sufficient to return the expandable member 620 to its original shape when not compressed. The expandable member 620 is also annularly formed about a longitudinal axis $A_1$ of a shaft 660 positioned along the center of the arbor. As in all the embodiments of the present invention, the expandable member 620 has an outer diameter less than an inner diameter 650 of the brush 610 when in the non-expanded position, and greater then the inner diameter 650 when in the expanded position. Additionally, the expandable member 620 spans the length of the brush 610, to provide support for the brush 610 during a cleaning operation. Slidably positioned about the shaft 660 are pressure hubs 680. Securing the pressure hubs 680 against the ends of the expandable member 620 are nuts 630 threadedly coupled to the shaft 660.

In this advantageous embodiment, once the brush 610 is properly positioned about the arbor, one or both of the nuts 630 are turned about the shaft 660 so as to drive them towards a center of the arbor along the axis $A_1$. As the nuts 630 move towards the center of the arbor, they apply a compression force 670 to the outside of the pressure hubs 680. This compression force 670, in turn, causes the pressure hubs 680 to slide along the shaft 660 and move towards the center of the arbor. Since the pressure hubs 680 rest against the expandable member 620, the compression force 670 eventually compresses the expandable member 620 from its ends, causing its overall length to decrease. Compressing the expandable member's 620 length forces its outer diameter to increase in size, creating an outward force 640. The outward force 640 results in the outer diameter of the expandable member 620 pressing firmly against the inner diameter 650 of the brush 610, as illustrated. With the expandable member 620 in this expanded position, the brush 610 is thus securely held in position for the cleaning operation.

Removal of the brush 610 follows a similar procedure. To remove the brush 610 the nuts 630 are turned in a direction opposite the direction turned for mounting the brush 610. This then releases the compression force 670 applied to the pressure hubs 680 and the ends of the expandable member 620. Since the expandable member 620 is comprised of an elastic material, it is permitted to return to its original shape. When the expandable member 620 returns to its original shape, its outer diameter again becomes less than the inner diameter 650 of the brush 610. With the outer diameter decreasing in size, the outward force 640 is removed from the inner diameter 650 of the brush 610. This, in turn, allows the brush 610 to be easily dismounted from the arbor and replaced with a new one.

Figure 7:
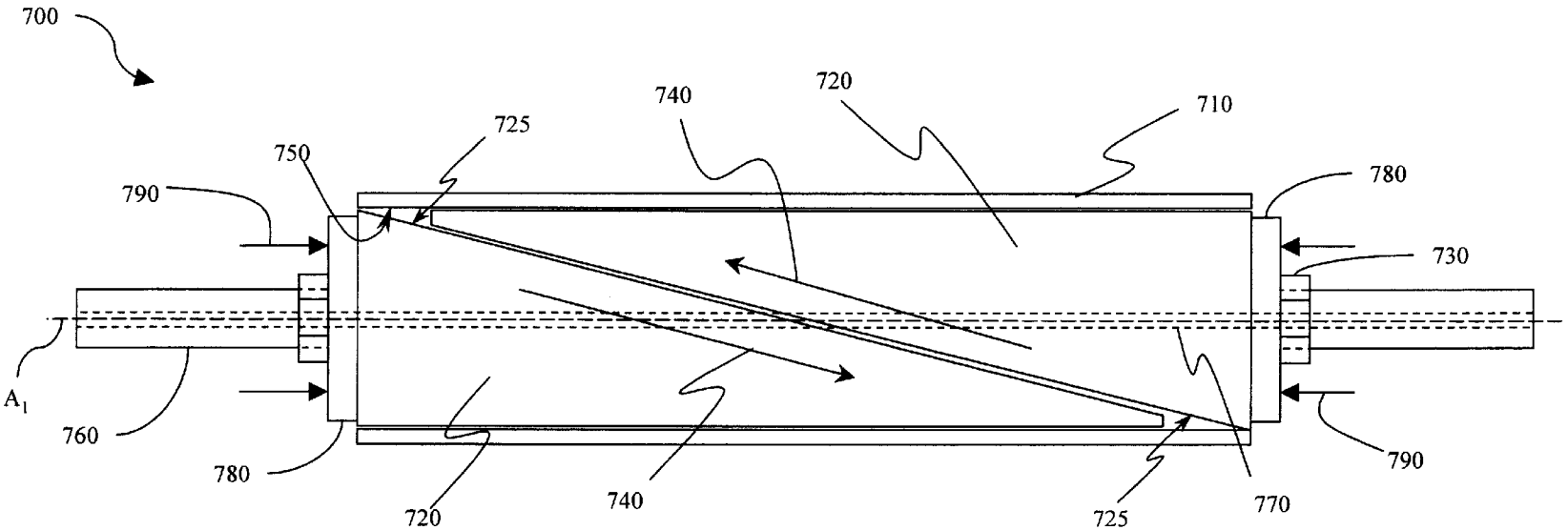
FIG. 7 illustrates a side, sectioned view of yet another alternative embodiment of a cleaning brush assembly constructed according to the present invention.

Turning attention now to FIG. 7, illustrated is yet another alternative embodiment of a cleaning brush assembly 700 constructed according to the present invention. FIG. 7 illustrates a side, sectioned view of this brush assembly 700.

The brush assembly 700 includes a cylindrical cleaning brush 710 positioned about an arbor (720, 730, 760, 770, 780). In this embodiment, the arbor includes an expandable member 720 comprised of first and second opposing tapered cylindrical segments. Each of the segments of the expandable member 720 have a flat inner face 725, and those faces 725 are positioned in contact with one another. By positioning the faces 725 towards one another, the two segments combine to form the circular outer diameter of the expandable member 720. When positioned together in this manner, the segments may slide faces 725 against each other to give the expandable member 720 a non-expanded outer diameter less than an inner diameter 750 of the brush 710, or an expanded outer diameter greater than the inner diameter 750 of the brush 710.

The brush assembly 700 further includes an axle 770 positioned along a longitudinal axis $A_1$ of a mounting shaft 760. The axle 770 passes through the segments of the expandable member 720, and the segments are slidably coupled thereto. The brush assembly 700 still further includes first and second pressure hubs 780, slidably coupled to the axle 770. The pressure hubs 780 are in contact with the outer ends of the expandable member 720, and held in place by nuts 730 which are threadedly coupled about the shaft 760.

Mounting the brush 710 on this embodiment of the present invention requires the following process. With the expandable member 720 in the non-expanded position, the brush 710 is positioned about the arbor. Once the brush 710 is in the proper location, one or both of the nuts 730 are turned about the shaft 760 to drive the nuts 730 towards the center of the arbor. As the nuts 730 are driven inward, an inward force 790 is applied against the pressure hubs 780. This inward force 790 is then applied via the pressure hubs 780 to the respective ends of the segments of the expandable member 720. Since the inner faces 725 of the segments are in contact with one another, the inward force 790 causes the segments to slide in the expanding direction 740, with the axle 770 maintaining their lateral position. With the segments sliding in the expanding direction 740, the outer diameter of the expandable member 720 increases in size until it contacts the inner diameter 750 of the brush 710. As the outer diameter of the expandable member 720 reaches the inner diameter 750 of the brush 750, the brush 710 becomes firmly held in position for the cleaning operation. It should be noted, however, that the slight pressure applied by the segments when in the expanded position is significantly less than the stresses associated with the prior art technique of forcibly stretching the cleaning brush 710 onto the arbor.

For a technician to remove the brush 710 from the arbor, one or both of the nuts 730 must be rotated in a direction opposite the direction turned to mount the brush 710. As the nuts 730 are so turned, the inward force 790 is removed from the pressure hubs 780, and eventually the segments of the expandable member 720. With the inward force 790 eliminated, the reaction force of the inner diameter 750 of the brush 710, caused by the slight pressure of the wedging effect of the segments, acts against the outer diameter of the expandable member 720. This then slides the segments in the opposite direction of the expanding force 740. As noted above, the outer diameter of the expandable member 720 is then less than the inner diameter 750 of the brush 710, allowing the brush 710 to be removed from the arbor with little effort.

Figure 8A:
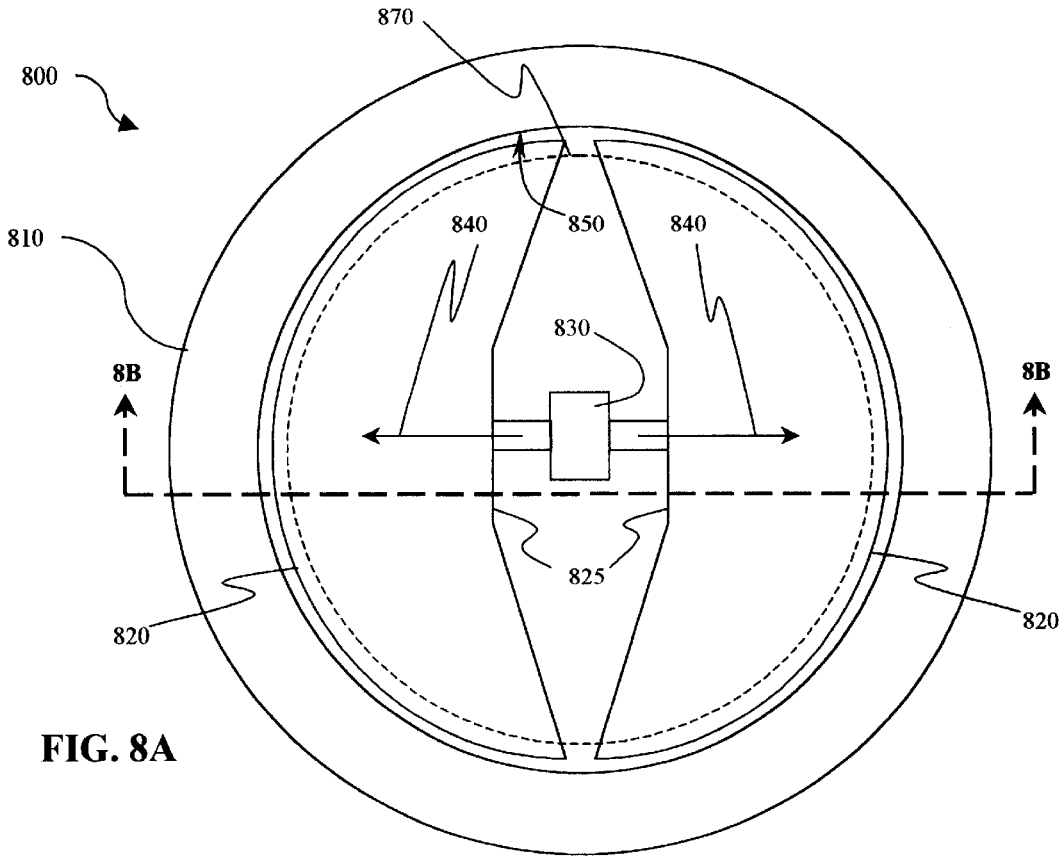
FIG. 8A illustrates a top, sectioned view of still a further embodiment of a brush assembly according to the present invention.
Figure 8B:
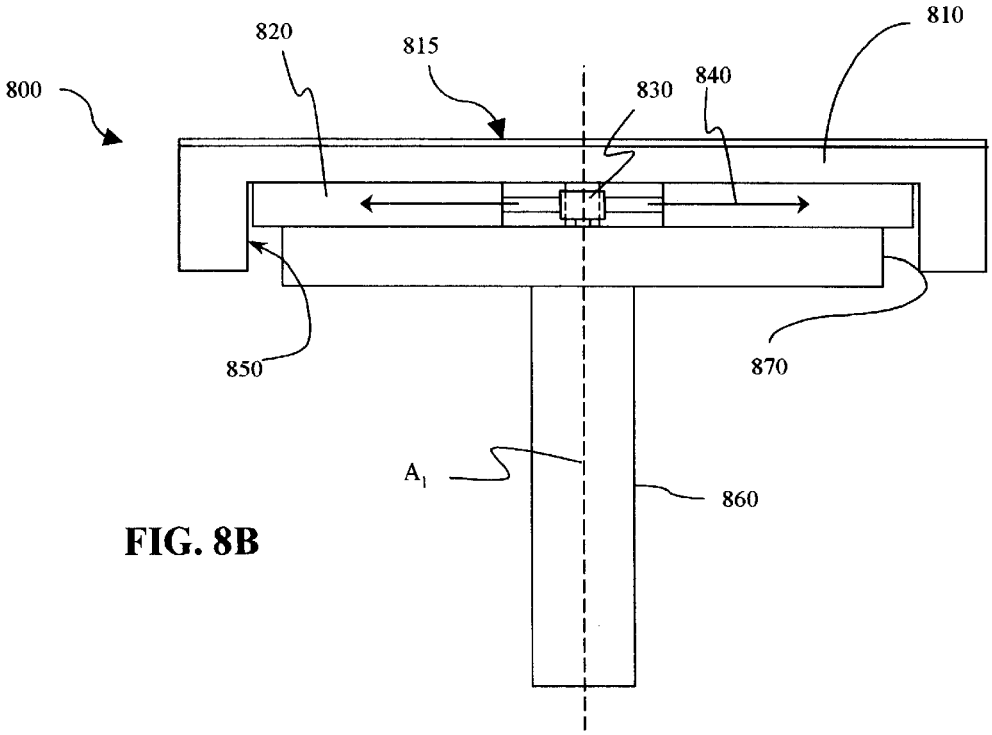
FIG. 8B illustrates a side, sectioned view of the assembly of FIG. 8A.

Turning finally to FIGS. 8A and 8B, illustrated is still a further exemplary embodiment of the present invention. FIG. 8A illustrates a top, sectioned view of a brush assembly 800 different in design than the previously described embodiments. FIG. 8B illustrates a side, sectioned view of this embodiment.

Viewing FIGS. 8A and 8B concurrently, the brush assembly 800 includes a cleaning brush 810 and an arbor (820, 830, 860, 870), both significantly different in shape than the previous embodiments described above in order to help illustrate the broad scope of the present invention. Specifically, the brush 810 is a flat, circular shape having a cleaning surface 815 on one face rather than around the periphery of the entire brush 810. Opposite the cleaning face 815 is a recessed face for mounting the brush 810 onto the arbor. During the cleaning process the cleaning face 815 of the brush 810 is placed flat against a semiconductor wafer (not illustrated) and rotated about an axis $A_1$ perpendicular to the cleaning face 815.

To securely hold the brush 810 during the cleaning process, the arbor is comprised of a shaft 860 coupled to one face of a flat, circular supporting plate 870. Slidably coupled to the opposite face of the supporting plate 870 is an expandable member 820 having first and second opposing, essentially semi-circular components. The components are configured to slide towards or away from each other to create respective non-expanded and expanded positions of the expandable member 820. The expandable member 820 is moved from the non-expanded to the expanded position, and back again, via an expander 830 coupled to the supporting plate 870. Specifically, the expander 830 is configured to exert opposing expanding forces 840 against inner flat edges 825 of the components.

To mount the brush 810 on the arbor, the expandable member 820 must first be in the non-expanded position, as described above. The end of the arbor having the expandable member 820 is then inserted into the recessed face of the brush 810. As before, in the non-expanded position the expandable member 820 has an outer diameter (i.e., the curved edges of the components) less than an inner diameter 850 of the recessed face of the brush 810. Once the brush 810 is flat against the arbor, the technician replacing the brush 810 causes the expandable member 820 to move to the expanded position. To accomplish this, the expander 830 exerts the opposing expanding force 840 against the flat edges 825 of the components, sliding their curved edges outward against the inner diameter 850 of the recessed brush face. Once the components contact the inner diameter 850, the brush 810 is securely held for the cleaning operation.

To remove the brush 810, the technician simply reverses the process. More specifically, the technician causes the expander 830 to reverse the expanding force 840 it is exerting on the flat edges 825 of the components of the expandable member 820. This results in the components being pulled and sliding towards one another in a direction opposite the expanding force 840. By sliding closer together, the components decrease the outer diameter of the expandable member 820 to less than the inner diameter 850 allowing the technician to simply lift the brush 810 off of the arbor.

In accordance with the present invention, the expander 830 may be a hydraulic device having opposing pistons attached to the components of the expandable member 820. Alternatively, the expander 830 may be pneumatic expander 830, but is broad enough to encompass any device configured to expand and contract the components. Additionally, while the brush assembly 800 has also been described having an expandable member 820 with two sliding components opposing the expander 830, the present invention is not so limited. One who is of ordinary skill in the art may readily design other configurations of the expandable member 820 involving multiple components, as well as their operation by a pneumatic, hydraulic, or mechanical expander 830, such as an outwardly grasping chuck, without departing from the broad scope of the present invention.

Although numerous embodiments of the present invention have been described herein, nothing in the foregoing discussion should be interpreted as limiting the present invention to any one of the particular embodiments described. In addition, although the embodiments herein have been described having specific components for varying purposes, any number of components configured to accomplish the same purposes may be substituted and still be within the scope of the present invention. Therefore, in its broadest form, the present invention simply provides a semiconductor wafer cleaning brush assembly having an arbor with an expandable member configured to have a non-expanded position and an expanded position, and a cleaning brush, locatable about the expandable member, having an inner diameter greater than an outer diameter of the expandable member in the non-expanded position and less than an outer diameter of the expandable member in the expanded position.

Although the present invention has been described in detail, those skilled in the art should understand that they can make various changes, substitutions and alterations herein without departing from the spirit and scope of the invention in its broadest form.

What is claimed is:

1. A method of cleaning a semiconductor wafer comprising:

providing an arbor having an expandable member configured to have a non-expanded position and an expanded position;

contracting the arbor to the non-expanded position with the expandable member;

placing a cleaning brush about the arbor, the cleaning brush having an inner diameter greater than an outer diameter of the expandable member in the non-expanded position and less than an outer diameter of the expandable member in the expanded position;

expanding the expandable member to the expanded position;

contacting a semiconductor wafer with the cleaning brush; and rotating the cleaning brush.

2. The method of cleaning a semiconductor wafer as recited in claim 1 wherein providing includes providing an arbor having an annular bladder with a fluid valve coupled to and in fluid communication with an interior of the bladder.

3. The method of cleaning a semiconductor wafer as recited in claim 1 wherein providing includes providing an arbor comprising:

a bladder located within an interior annulus of the arbor; and an expandable member having radially-movable segments extending about a longitudinal axis of the arbor and about the bladder and having support members located between the segments, the support members coupling the segments together.

4. The method of cleaning a semiconductor wafer as recited in claim 1 wherein providing includes providing an arbor comprising a semi-rigid elastic material and a bladder located about a longitudinal axis of the arbor.

5. The method of cleaning a semiconductor wafer as recited in claim 1 wherein providing includes providing an arbor comprising:

an axle coupled to a center of a stabilizing hub and extending along a longitudinal axis of the arbor;

opposing essentially semi-circular elements coupled to a periphery of the stabilizing hub and located about the axle; and an expander coupled to the axle and configured to exert a force against an interior of the opposing essentially semi-circular elements.

6. The method of cleaning a semiconductor wafer as recited in claim 5 wherein providing includes providing an arbor wherein the axle comprises a hydraulic tube and the expander comprises opposing hydraulic pistons mechanically coupled to and in fluid communication with the hydraulic tube.

7. The method of cleaning a semiconductor wafer as recited in claim 5 wherein providing includes providing an arbor wherein the axle comprises a threaded rod and the expander comprises an opposing scissor jack threadedly coupled to the threaded rod.

8. The method of cleaning a semiconductor wafer as recited in claim 1 wherein providing includes providing an arbor comprising:

an annular, elastic expandable member located about a shaft and extending about a longitudinal axis of the arbor; and first and second annular pressure hubs located about the shaft, the first pressure hub configured to compress a first end of the expandable member and the second pressure hub configured to compress a second end of the expandable member.

9. The method of cleaning a semiconductor wafer as recited in claim 1 wherein providing includes providing an arbor comprising:

first and second opposing tapered cylindrical segments, each tapered cylindrical segments having a flat inner face; and an axle coupled to a center of a pressure hub and extending along a longitudinal axis of the first and second tapered cylindrical segments, the pressure hub configured to cause the flat inner face of the first tapered cylindrical segment to slide upon the flat inner face of the second tapered cylindrical segment.

10. The method of cleaning a semiconductor wafer as recited in claim 1 wherein providing includes providing an arbor comprising:

an expandable member having opposing essentially semi-circular components coupled to a supporting plate; and an expander, coupled to the supporting plate, configured to exert opposing forces against inner flat edges of the essentially semi-circular components.

11. The method of cleaning a semiconductor wafer as recited in claim 1 wherein the arbor is a first arbor and the cleaning brush is a first cleaning brush and contacting includes contacting a semiconductor wafer between the first cleaning brush and a second cleaning brush opposing the first cleaning brush.

12. The method of cleaning a semiconductor wafer as recited in claim 1 wherein the semiconductor wafer includes integrated circuits located thereon.

* * * * *